US005083881A

United States Patent [19]

Yoshinaga

[11] Patent Number: 5,083,881

[45] Date of Patent: Jan. 28, 1992

[54] WRITING TOOL INCLUDING OPENABLE DECORATIVE ARTICLE AT SHAFT END

[75] Inventor: Sadao Yoshinaga, Ichikawa, Japan

[73] Assignee: Yoshinaga Tecnica Corp., Tokyo, Japan

[21] Appl. No.: 728,655

[22] Filed: Jul. 11, 1991

[30] Foreign Application Priority Data

Jul. 30, 1990 [JP] Japan ..... 2-81086

[51] Int. Cl.[5] ..... B43K 29/00

[52] U.S. Cl. ..... 401/195; 401/112

[58] Field of Search ..... 401/195, 52, 112

[56] References Cited

U.S. PATENT DOCUMENTS 3,695,612 10/1972 Barrios ..... 401/112 X 3,985,455 10/1976 Wahlberg ..... 401/112 X

*Primary Examiner*—Steven A. Bratlie

*Attorney, Agent, or Firm*—Weingarten, Schurgin, Gagnebin & Hayes

[57] ABSTRACT

A writing tool such as a ball pen or the like including an openable decorative article at a shaft end comprises a shaft member serving as a casing for the writing tool, a core vertically displaceably received in the shaft member, an actuation member connected to the core, a movable member adapted to move when the core is downwardly displaced at the time of practical use of the writing tool, and a support member for supporting the decorative article. The actuation member includes a fixing piece and an actuation piece protruded outside of the shaft member. When an user displaces the actuation piece in the downward direction with his finger for practical use of the writing tool, an assembly of the movable member and the support member is displaced in the same direction, whereby the decorative article is expanded via a flange integrated with the support member as if petals of a flower are opened. At this time, a butterfly-shaped accessory fixedly mounted on the central part of the support member appears.

5 Claims, 3 Drawing Sheets

WRITING TOOL INCLUDING OPENABLE DECORATIVE ARTICLE AT SHAFT END

BACKGROUND OF THE INVENTION

1. Field of the Invention

The present invention relates generally to a writing tool including an openable decorative article at a shaft end. More particularly, the present invention relates to a writing tool such as a knock type ball pen, an ever-sharp pencil or the like including an openable decorative article at a shaft end wherein the decorative article can be opened and closed in synchronization with outward/inward displacement of a core.

2. Description of the Related Art

To allow an user to feel an interest in practical use of a writing tool, a proposal has been already made with respect to arrangement of a various kind of decorative article at a shaft end of the writing tool. Most of the conventional decorative articles are used in the fixed state while each decorative article is connected to a shaft member, whereby an user feels an interest as if he plays with a toy. Some of the decorative articles exhibit movement to a certain extent but this movement is such that it is induced by vibration of a spring attached to the decorative article or operation of a movable member incorporated in the decorative article.

In practice, an interest derived from practical use of the writing tool similar to an interest derived from playing with a toy is induced by dynamic variation of a decorative article disposed at a shaft end of the writing tool. In addition, it is desirable that movement of the decorative article is achieved in a single pattern and moreover it is preferable that operation of the movable member is performed without any contact with the decorative article. With respect to the conventional writing tool, it has been found that movement of the decorative article is simple and monotonous, resulting in an extent of interest to be pleasantly felt by an user being insufficient.

SUMMARY OF THE INVENTION

The present invention has been made with the foregoing background in mind.

An object of the present invention is to provide a writing tool including an openable decorative article at a shaft end wherein the decorative article can be opened and closed by outward/inward displacement of a core carried out by an actuation member based on the operational relationship between the actuation member for displacing the core in the outward/inward direction and the decorative article.

Another object of the present invention is to provide a writing tool including an openable decorative article at a shaft end wherein an user can enjoy an interest as if he operates a toy.

To accomplish the above objects, the present invention provides a writing tool including an openable decorative article at a shaft end, wherein the writing tool comprises a shaft member including a fixing hole on the upper side and a vertically extending actuation hole on the lower side, the shaft member having an opposing pair of guide grooves formed on the side wall thereof, each of the guide grooves extending to reach the upper open end of the shaft member; a core vertically displaceably received in the shaft member; an actuation member having a vertically extending resilient member integrated therewith, the resilient member including a fixing piece to be engaged with the fixing hole and an actuation piece received in the actuation hole, the fixing piece and the actuation piece projecting outward of the resilient member, the actuation member being molded integral with a connecting member on the top end thereof; the decorative article being composed of a required number of radially extending opening/closing pieces molded integral with a ring member around the outer surface of the same and a movable member having a fitting member serving as a connector molded integral therewith in an outer sleeve via spacers in the concentrical relationship, the opening/ closing pieces being displaceable in the upward/downward direction, the outer sleeve including a plurality of support pieces for holding the opening/closing pieces around the upper edge thereof; the movable piece being fitted into the upper open end of the shaft member with the spacers being fitted into the guide grooves; the actuation member being operatively connected to the movable member via the connecting member of the actuation member and the fitting member of the movable member; and the ring member being placed on the upper end of the shaft member so as to allow the opening/closing pieces of the decorative article to be supported by the movable member.

It is desirable that the connecting member of the actuation member comprises a male-threaded shaft which extend from the top end of the actuation member.

With such arrangement of the male-threaded shaft, the movable member is operatively connected to the actuation member via the male-threaded shaft inserted through the fitting member. In addition, the male-threaded shaft is threadably fitted into an accessory support member so that an accessory having an arbitrary configuration is fixedly mounted on the support member in the central part of the decorative article including a plurality of opening/closing pieces.

Further, it is desirable that the support member includes a flange as means for reliably expanding the opening/closing pieces in synchronization with downward displacement of the core by depressing the opening/closing pieces from the inside.

It is most preferable that the decorative article is composed of a plurality of opening/closing pieces in the form of petals and a movable member in the form of a calyx. With this construction of the decorative article, an user feels an interest as if he visually observes the behavior of a bud which grows and comes in blossom.

When the writing tool is practically used, an user downwardly displaces the actuation piece protruded outward of the actuation hole with his finger so that the foremost end of the core is displaced downward of the lower end of the shaft member against the resilient force of a spring. This causes the movable member operatively connected to the actuation member via the fitting member to be displaced downwardly, whereby the opening/closing pieces are displaced in the same direction together with the movable member while they are supported by the movable member via upper edges of the opening/closing pieces.

As the movable member is displaced downwardly, the support points at which the opening/closing pieces contact the movable member are displaced to the lower side. This causes the opening/closing pieces to be radially expanded. At this time, since the accessory support member is likewise displaced in the downward direction, the lower parts of the opening/closing pieces are depressed by a flange fixedly mounted on the support member so that all the opening/ closing pieces are uniformly expanded.

When an user depresses the actuation piece with his finger to disengage the fixing piece from the shaft member, the core is retracted to the original position together with the actuation member and the movable member is upwardly displaced while squeezing the opening/closing pieces with the support member, whereby the opening/closing pieces assume the original closed state.

Other objects, features and advantages of the present invention will become apparent from reading of the following description which has been made in conjunction with the accompanying drawings.

BRIEF DESCRIPTION OF THE DRAWINGS

The present invention is illustrated in the following drawings in which.

DESCRIPTION OF THE PREFERRED EMBODIMENTS

Now, the present invention will be described in detail hereinafter with reference to the accompanying drawings which illustrate preferred embodiments of the present invention.

Figure 1:
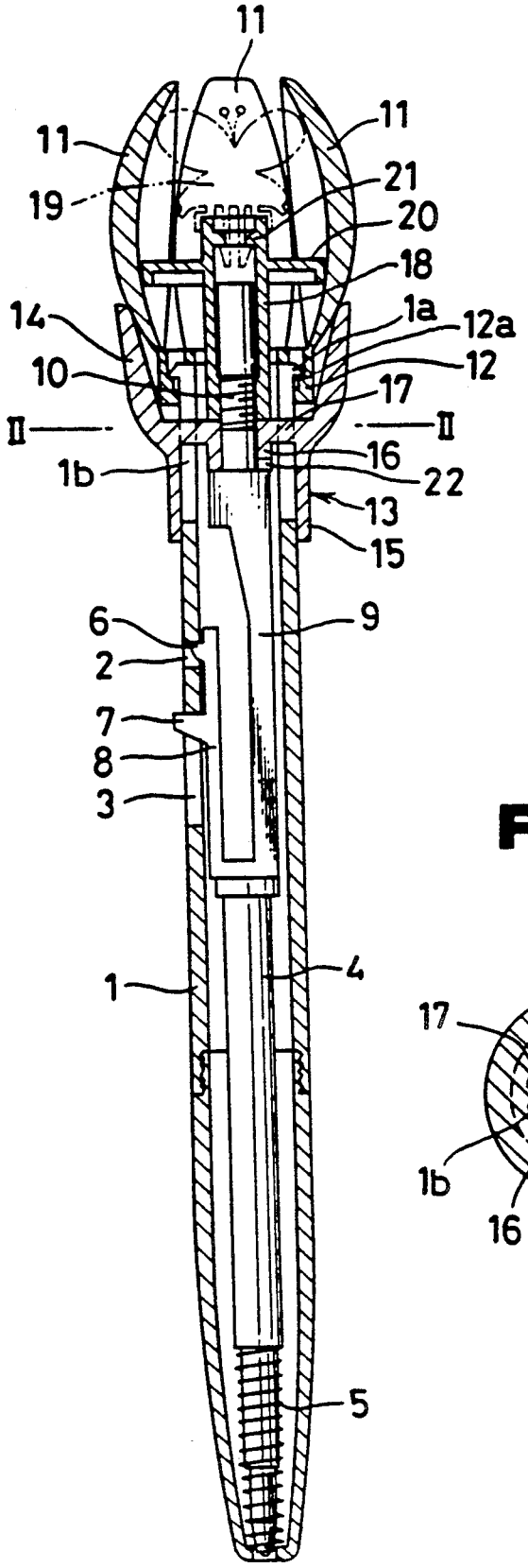
FIG. 1 is a sectional view of a writing tool in the form of a ball pen including an openable decorative article at a shaft end in accordance with an embodiment of the present invention, particularly illustrating that the decorative article is kept closed.
Figure 2:
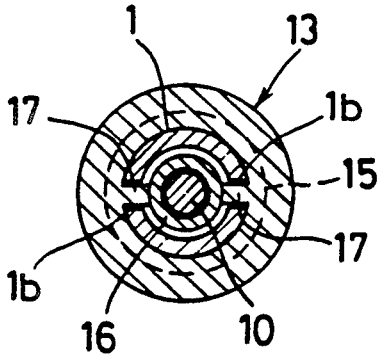
FIG. 2 is a cross-sectional view of the writing tool taken along line II—II in FIG. 1.

FIG. 1 is a sectional view of a writing tool in the form of a ball pen including an openable decorative article at a shaft end of the writing tool in accordance with an embodiment of the present invention. In the drawing, reference numeral 1 designates a shaft member for the ball pen wherein the upper end of the shaft member is opened to the outside. The shaft member 1 includes a fixing hole 2 and a vertically extending actuation hole 3. As is apparent from the drawing, the fixing hole 2 is located above the actuation hole 3.

The upper end of the shaft member 1 is radially enlarged in the form of a projection around its opening edge 1*a*, and an opposing pair of guide grooves 1*b* are slotted in the vertical direction along the side wall of the shaft member 1.

Reference numeral 4 designates a core for the ball pen. The core 4 is vertically displaceably received in the shaft member 1 together with a spring 5 disposed at the lower end part of the ball pen.

A V-shaped actuation member 9 molded of a synthetic resin having a property of resiliency is connected to the upper part of the core 4. The actuation member 9 includes a vertically extending resilient member 8 having a fixing piece 6 and an actuation piece 7 projected outward of the outer surface thereof. The actuation member 9 is received in the actuation hole 3 and a part of the actuation piece 7 is protruded outside of the outer surface of the shaft member 1. In addition, a male-threaded shaft 10 serving as a joint member is molded integral with the upper end of the actuation member 9.

Reference numeral 11 designates an openable member disposed above the upper end of a male-threaded shaft 10 to constitute a part of the decorative article. According to the embodiment of the present invention, the openable member 11 comprises five openable pieces each in the form of a petal which are molded of a synthetic resin such as a polypropylene or the like. The openable member 11 includes a ring member 12 having a stepped engagement part 12*a* formed around the inner peripheral edge. With this construction of the openable member 11, the five petals radially extending from the outer periphery of the ring member 12 are turnably displaced in the upward/downward direction to turn about their base ends.

Reference numeral 13 designates a movable member molded of a synthetic resin in the form of a calyx. The movable member 13 constitutes another part of the decorative article and moves in operative association with the openable member 11. The movable member 13 is constructed such that a cylindrical fitting member 16 is molded integral with a sleeve 15 in the concentrical relationship. The sleeve 15 includes five support pieces 14 for holding the openable member 11 around its upper periphery.

Reference numeral 18 designates a support member for an butterfly-shaped accessory 19. The support member 18 is molded in the form of a sleeve having a female-threaded part to be threadably engaged with the male-threaded shaft 10 and includes a flange 20 at its upper end part. In addition, the support member 18 includes a stepped engagement part 21 for receiving the butterfly-shaped accessory 19 at its upper end.

Reference numeral 22 designates a rotation preventive piece which is formed at the lower end of the male-threaded shaft 10. To prevent rotation of the movable member 13, the rotation preventive piece 22 is fitted into a cutout (not shown) which is formed at the lower end of the fitting member 16.

Figure 5:
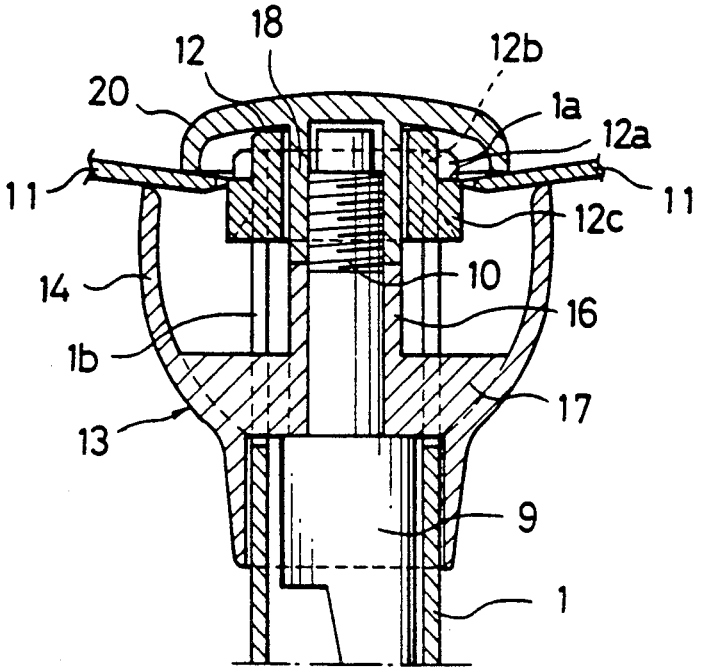
FIG. 5 is a fragmentary sectional view of the writing tool, particularly illustrating that a ring member is fitted into the opened end of a shaft member in accordance with another embodiment of the present invention.
Figure 6:
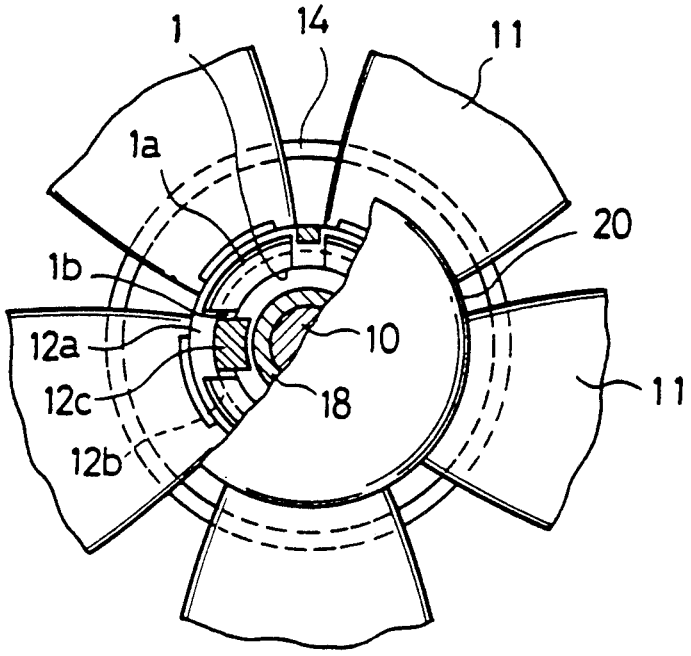
FIG. 6 is a partially exploded plan view of the writing tool in FIG. 5.

FIG. 5 is a fragmentary sectional view of the writing tool, particularly illustrating a structure of the ring member 12 in accordance with another embodiment of the present invention. According to this embodiment, the ring member 12 includes a stepped part 12*a* at its upper end, and elongated fitting holes 12*b* are formed around the stepped part 12*a* in the circumferential direction. In addition, the ring member 12 is formed with insert portions 12*c* at its upper end at the positions corresponding to the guide grooves 1*b* on the shaft member 1. The insert portions 12*c* are fitted into the guide grooves 1*b* thereby to prevent rotation of the ring member 12 relative to the shaft member 1.

Next, description will be made below as to how the openable member 11, the movable member 13 and the support member 18 are fitted to the upper end of the shaft member 1.

First, the sleeve 15 of the movable member 13 is fitted onto the upper end of the shaft member 1. While the positions of the guide grooves 1*b* are correctly aligned with the positions of the spacers 17, the movable member 13 is displaced further in the downward direction until the fitting member 16 is fitted onto the male-threaded shaft 10 to come in contact with the upper end face of the actuation member 9. Subsequently, the openable member 11 is placed on the fitting member 16.

Fitting of the openable member 11 can easily be achieved in the same manner as a fitting operation performed for a snap ring in such a manner that while the openable member 11 is kept opened, the ring member 12 is placed on the opening edge 1*a* and it is then forcibly displaced in the downward direction. As the ring member 12 is displaced in the downward direction, it is fitted into the upper open end of the shaft member 1 so that the openable member 11 is firmly held on the upper end of the shaft member 1.

Next, the support member 18 for the accessory 19 is threadably fitted onto the male-threaded shaft 10 until the the lower end of the fitting sleeve 16 comes in contact with the upper end face of the actuation member 9. Consequently, the movable member 13 is fixedly held on the actuation member 9 via the fitting member 16. It should be noted that a fitting operation for the support member 18 is performed while the openable member 11 is kept opened.

On completion of the fitting operation, the movable member 13 is ready to move in the vertical direction together with the core 4 which has been integrated with the actuation member 9. As the foremost end of the core 4 is displaced outside of the lower end of the shaft member 1 and it is retracted in the interior of the shaft member 1, the movable member 13 is displaced in the upward/downward direction at the upper end part of the shaft member 1. This causes the openable member 11 composed of a plurality of petals to be opened and closed.

With such construction of the ball pen as described above, when the actuation piece 7 protruded outside of the actuation hole 3 is depressed with an user's finger, the core 4 is displaced downwardly against the resilient force of the spring 5, whereby the foremost end of the core 4 is protruded outside of the the lower end of the shaft ember 1 and at the same time the movable member 13 is displaced downwardly.

Figure 3:
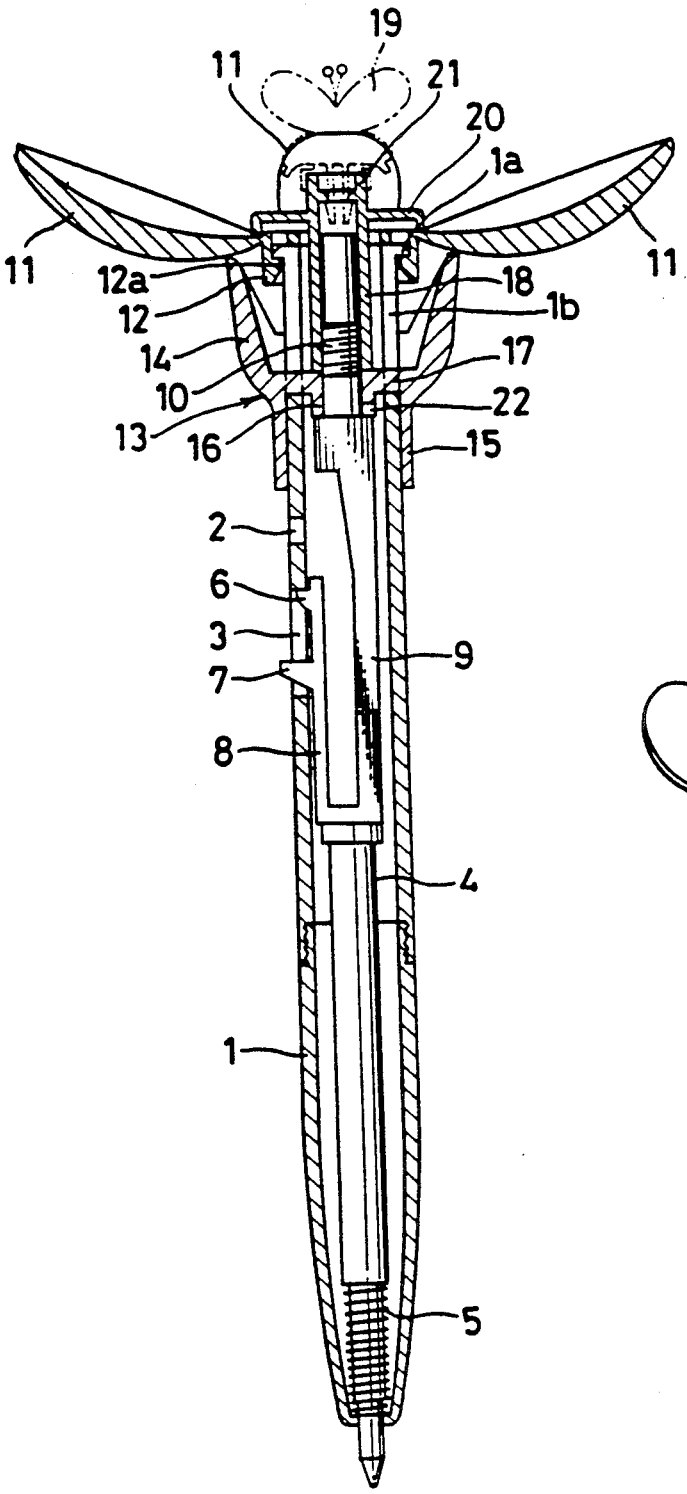
FIG. 3 is a sectional view of the writing tool in FIG. 1, particularly illustrating that the decorative article is kept opened.
Figure 4:
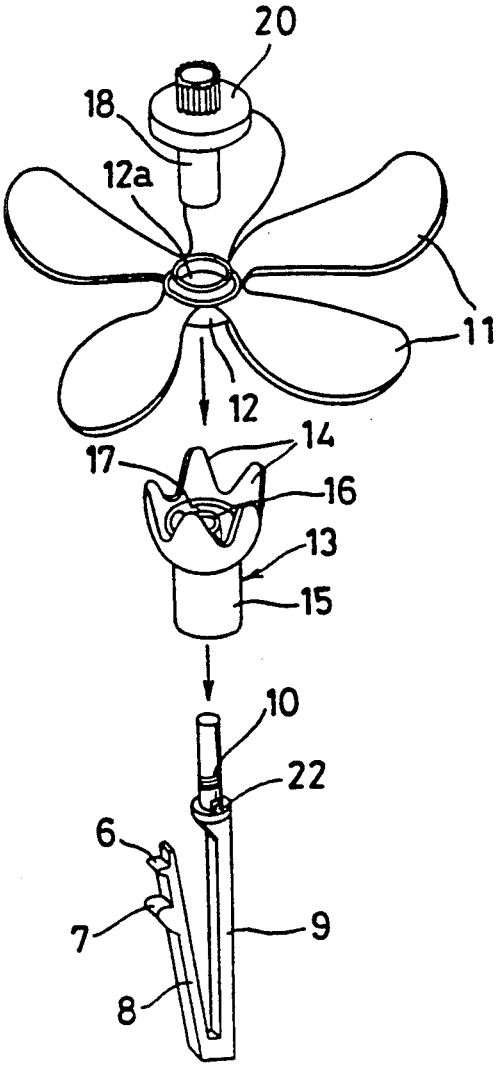
FIG. 4 is a fragmentary perspective view of the writing tool in FIG. 1, particularly illustrating essential components constituting the writing tool in a disassembled state.

As downward displacement of the movable member 13 is carried out in the above-described manner, the support points at which the upper edges of the support pieces 14 contact the openable member 11 are displaced to the lower side, allowing the openable member 11 to be opened. An opening operation of the openable member 11 continues until the fixing piece 6 reaches the upper edge of the actuation hole 3. At this time, the core 4 is fixedly held in the protruded state, as shown in FIG. 3. In addition, since the flange 20 depresses the inner part of the openable member 11, the whole openable member 11 is uniformly expanded and thereby the accessory 19 fixedly mounted on the support member 18 appears in the central part of the openable member 11.

When the fixing piece 6 is released from the engaged state by squeezing the actuation piece 7 with an user's finger, the core 4 is retracted to the original position by the resilient force of the spring 5 and the movable member 13 resumes the original position, whereby the openable member 11 is raised up by the support pieces 14 on the movable member 13. As a result, the openable member 11 is brought in the closed state, as shown in FIG. 1.

As described above, according to the present invention, an openable decorative article fixedly secured to the shaft end is opened and closed in synchronization with outward/inward displacement of the core 4 caused by the actuation piece 9. In other words, the decorative article is opened and closed merely by depression of the actuation piece 9 and subsequent downward displacement of the same. This causes an appearance of the decorative article to vary dynamically, resulting in an interest in variation of the appearance being induced. Thus, an user can enjoy such an interest that grows and comes in blossom, provided that it is assumed that a decorative article to be opened and closed is a flower.

Although the present invention has been described above with respect to the case where a decorative article to be opened and closed is a flower, it should of course be understood that the present invention should not be limited only to this case. Alternatively, the present invention may equally be applied to any decorative article, provided that this decorative article induces an interest in response to an user's opening/closing operation. The configuration of a movable member may arbitrarily be changed or modified corresponding to the configuration of an openable member constituting the decorative article. In other words, the present invention should not be limited only to the configuration of the decorative article which has been employed for practicing each of the preferred embodiments thereof.

What is claimed is:

1. A writing tool including an openable decorative article at a shaft end, comprising;

a shaft member including a fixing hole on the upper side and a vertically extending actuation hole on the lower side, said shaft member having an opposing pair of guide grooves formed on the side wall thereof, each of said guide grooves extending to reach the upper open end of the shaft member, a core vertically displaceably received in the shaft member, an actuation member having a vertically extending resilient member integrated therewith on the outside relative to said actuation member, said resilient member including a fixing piece to be engaged with said fixing hole and an actuation piece received in said actuation hole, said fixing piece and said actuation piece projecting outward of said resilient member, said actuation member being molded integral with a connecting member on the top end thereof, said decorative article being composed of a required number of radially extending opening/closing pieces molded integral with a ring member around the outer surface of the same and a movable member having a fitting member serving as a connector molded integral therewith in an outer sleeve via spacers in the concentrical relationship, said opening/closing pieces being displaceable in the upward/downward direction, said outer sleeve including a plurality of support pieces for holding said opening/closing pieces around the upper edge thereof, said movable piece being fitted into the upper open end of the shaft member with said spacers being fitted into said guide grooves, said actuation member being operatively connected to said movable member via said connecting member of said actuation member and said fitting member of said movable member, and said ring member being placed on the upper end of the shaft member so as to allow said opening/closing pieces of said decorative article to be supported by said movable member.

2. The writing tool as claimed in claim 1, wherein the connecting member of the actuation member comprises a male-threaded shaft which extends from the top end of the actuation member, said male-threaded shaft allowing the movable member to be operatively connected to the actuation member while the fitting member of the movable member is fitted onto the male-threaded shaft, this male-threaded shaft being threadably engaged with a female-threaded hole in a support member which serves to support an accessory at the central part of the decorative article including a plurality of opening/closing pieces.

3. The writing tool as claimed in claim 2, wherein said support member includes a flange which serves to depress said opening/closing pieces from the inside when the writing tool is used.

4. The writing tool as claimed in claim 1, wherein the decorative article is composed of a plurality of opening/closing pieces in the form of petals and a movable member in the form of a calyx.

5. The writing tool as claimed in claim 2, wherein the decorative article is composed of a plurality of opening/closing pieces in the form of petals and a movable member in the form of a calyx.

* * * * *